US009609694B2

(12) United States Patent
Chaillet-Piquand

(10) Patent No.: US 9,609,694 B2
(45) Date of Patent: Mar. 28, 2017

(54) DEVICE FOR PACKAGING AND DISPENSING A COSMETIC COMPOSITION AND ASSOCIATED DISPENSING METHOD

(71) Applicant: L'OREAL, Paris (FR)

(72) Inventor: Noemie Chaillet-Piquand, Paris (FR)

(73) Assignee: L'Oreal, Paris (FR)

( * ) Notice: Subject to any disclaimer, the term of this patent is extended or adjusted under 35 U.S.C. 154(b) by 81 days.

(21) Appl. No.: 14/413,790

(22) PCT Filed: Jul. 11, 2013

(86) PCT No.: PCT/EP2013/064694
§ 371 (c)(1),
(2) Date: Jan. 9, 2015

(87) PCT Pub. No.: WO2014/009478
PCT Pub. Date: Jan. 16, 2014

(65) Prior Publication Data

US 2015/0136165 A1 May 21, 2015

(30) Foreign Application Priority Data

Jul. 12, 2012 (FR) ..... 12 56741

(51) Int. Cl.
*B01F 3/04* (2006.01)
*H05B 3/06* (2006.01)
(Continued)

(52) U.S. Cl.
CPC ..... *H05B 3/06* (2013.01); *A45D 34/00* (2013.01); *A45D 34/02* (2013.01);
(Continued)

(58) Field of Classification Search
CPC ..... B01F 3/04; B01F 3/04085; A45D 34/02; B05B 1/24
(Continued)

(56) References Cited

U.S. PATENT DOCUMENTS 5,094,025 A 3/1992 Daniels
6,406,004 B1 * 6/2002 Ude ..... A61L 9/122 261/104
(Continued)

FOREIGN PATENT DOCUMENTS

DE 10 2006 028 388 A1 12/2007
EP 2 397 118 A1 12/2011

OTHER PUBLICATIONS

International Search Report issued Aug. 6, 2013 in PCT/EP2013/064694 Filed Jul. 11, 2013.

*Primary Examiner* — Robert A Hopkins
(74) *Attorney, Agent, or Firm* — Polsinelli PC

(57) ABSTRACT

This device (10) for packaging and dispensing a cosmetic composition, which comprises:

a housing (12) capable of being grasped by a user of the device (10);

a reservoir (14) contained in the housing (12), the reservoir (14) being intended to contain a cosmetic composition, the cosmetic composition comprising at least one active substance;

an assembly (16) for heating the cosmetic composition capable of vaporizing the cosmetic composition de la composition;

a control member (18) able to control the heating assembly (16);

is characterized in that it has a driving member (22) capable of moving the vaporized cosmetic composition out of the device (10), the control member (18) being able to control the heating assembly (16) so that the vaporized cosmetic composition driven out of the device (10) by the driving member (22) permanently has a temperature less than 70° C.

14 Claims, 1 Drawing Sheet

(51) Int. Cl.

| | |
|---|---|
| ***B05B 1/24*** | (2006.01) |
| ***A45D 34/00*** | (2006.01) |
| ***A45D 34/02*** | (2006.01) |
| *A45D 34/04* | (2006.01) |

(52) U.S. Cl.
CPC ..... *B01F 3/04085* (2013.01); *B05B 1/24* (2013.01); *A45D 34/04* (2013.01); *A45D 2200/155* (2013.01)

(58) Field of Classification Search
USPC ..... 261/26, 30, 107, DIG. 88, DIG. 89; 422/124
See application file for complete search history.

(56) References Cited

U.S. PATENT DOCUMENTS

| | | | | |
|---|---|---|---|---|
| 8,201,752 | B2 * | 6/2012 | Brodbeck ..... | A01M 1/2077 239/13 |
| 2012/0004600 | A1 | 1/2012 | Nakamura | |

* cited by examiner

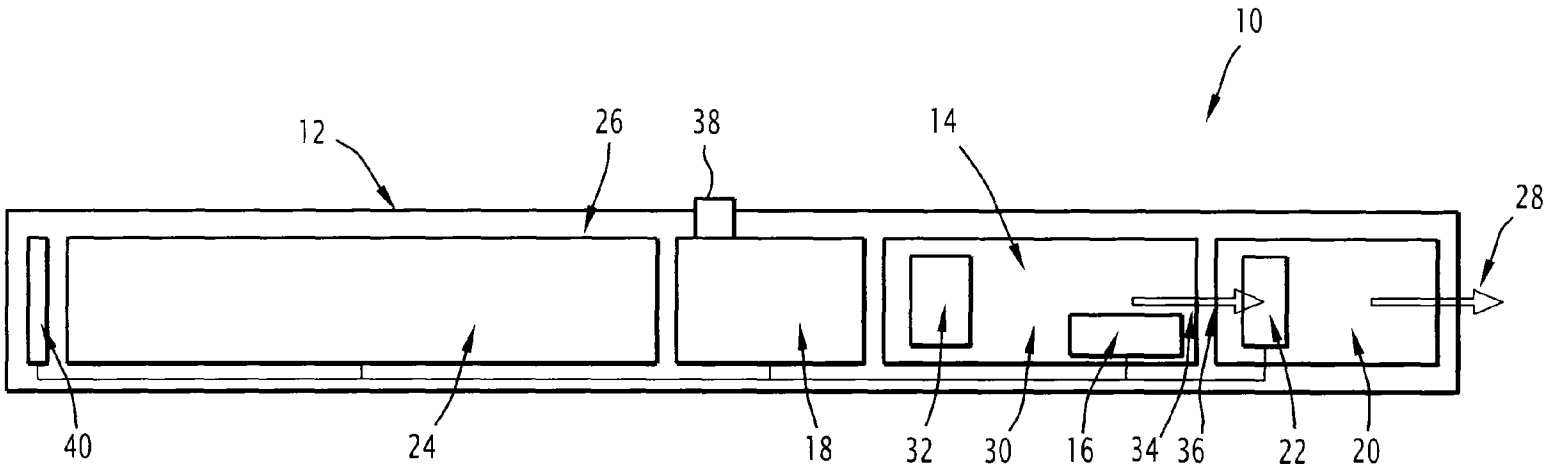
10
12
14
16
18
20
22
24
26
28
30
32
34
36
38
40

DEVICE FOR PACKAGING AND DISPENSING A COSMETIC COMPOSITION AND ASSOCIATED DISPENSING METHOD

BACKGROUND OF THE DISCLOSURE

Technical Field

This invention relates to a device for packaging and dispensing a cosmetic composition, the device comprising:

- a housing capable of being grasped by a user of the device;
- a reservoir contained in the housing, the reservoir being intended to contain a cosmetic composition, the cosmetic composition comprising at least one active substance;
- an assembly for heating the cosmetic composition, capable of vaporizing the cosmetic composition; and
- a control member able to control the heating assembly.

"Device for packaging" refers to any packaging that enables the sale, transport, protection and storage of the product that it contains.

The cosmetic composition contains at least one cosmetic product. "Cosmetic product" means, in particular, in the sense of this invention, a product as defined in EC Regulation n° 1223/2009 of the European Parliament and the Council of Nov. 30, 2009, relating to cosmetic products.

Background Art

The prior art already includes devices intended to diffuse a product in vapor state. This is the case in particular of WO 2004/064703, which describes a device for vaporizing water, the water vapor being intended to be applied to a portion of the body of a user.

However, this device requires heating means that must reach a high temperature in order for the water to be capable of reaching its vaporization temperature. Thus, this type of device requires a significant preheating time for the heating means before it can be used.

Other devices generating vapor exist, but are generally unsuitable for delivering cosmetic products and/or are bulky. This is the case, in particular, of WO 00/75135, US 2008/0226269, US 5094025 and WO 94/29032, which describe devices for vaporizing substances, for example odorizing substances, in the atmosphere.

One objective of the invention is therefore to provide a device for packaging and dispensing a cosmetic composition including means for heating the cosmetic composition requiring a preheating time that is reduced or imperceptible to the user, and enabling adapted dispensing of a vaporized cosmetic composition at a temperature and in a granulometric form in which the active substances present in the cosmetic composition are easily absorbed on a keratin surface.

BRIEF SUMMARY OF DISCLOSURE

To this effect, the invention relates to a device of the type mentioned above, characterized in that it has a driving member capable of moving the vaporized cosmetic composition out of the device, the control member being able to control the heating assembly so that the vaporized cosmetic composition driven out of the device by the driving member permanently has a temperature less than 70° C.

The device according to the invention may include one or more of the following features, taken alone or in any possible combination:

- the control member is able to control the driving member;

- the device comprises a member for activating the control member, capable of being actuated on the housing by a user of the device;
- the device comprises an electrical power supply source received in the housing, the source being capable of supplying electrical energy to the heating assembly and/or the driving member;
- the device comprises a diffusion chamber arranged between the reservoir and a discharge outlet provided in the housing through which the vaporized cosmetic composition is driven out of the device;
- the driving member is capable of generating a flow of vaporized cosmetic composition through the diffusion chamber between the reservoir and the discharge outlet;
- the reservoir includes an absorbent element able to retain the cosmetic composition;
- the reservoir can be removed from the housing;
- the housing is able to be manually carried by a user;
- the vaporization temperature of the cosmetic composition is less than 70° C., and in particular less than 50° C., for example between 30° C. and 50° C.; and
- the cosmetic composition includes at least one of the elements chosen from the group formed by glycerine, propylene glycol, propanediol, sorbitol, butylene glycol, pentylene glycol, polyethylene glycol 6, polyethylene glycol 8 or mixtures thereof.

The invention also relates to a method for cosmetic treatment of a keratin surface comprising the following steps:

- supply of a device according to any one of the previous claims;
- implementation of the control member in order to activate the heating assembly;
- heating and vaporization of the cosmetic composition;
- driving of the vaporized cosmetic composition out of the housing; and
- control of the temperature of the heating assembly by the control member so that the temperature of the vaporized cosmetic composition permanently has a temperature less than 70° C.

BRIEF DESCRIPTION OF THE DRAWING

The invention will be better understood in view of the following description, provided solely as an example, and with reference to the appended figure, which shows a schematic view of the packaging and dispensing device according to the invention.

DETAILED DESCRIPTION OF BEST AND VARIOUS EMBODIMENTS FOR CARRYING OUT DISCLOSURE

The packaging and dispensing device 10 shown in the single figure is, for example, intended to contain a cosmetic composition intended to be vaporized.

Before going into the vapor state, the cosmetic composition is in an initial form, such as, for example, in a liquid form, in the form of a lotion, a gel, an expanded form, in a solid form, or in the form of capsules, crystals or particles of different particle sizes and shapes.

The cosmetic composition includes at least one solvent. For example, the cosmetic composition includes at least one of the elements chosen from the group formed by glycerine, propylene glycol, propanediol, sorbitol, butylene glycol, pentylene glycol, polyethylene glycol 6 (PEG 6), polyethylene glycol 8 (PEG 8) or mixtures thereof.

The cosmetic composition further includes at least one cosmetic active substance of natural or chemically synthesized origin. This substance is formed, for example, by one or more essential oils, mineral oils, vitamins or proteins.

The active substance is, for example, formed by natural extracts of fruits, flowers, leaves or roots, hydrolysates, proteins, amino acids, peptides, fruit acids, silicones, alcohols, waxes, concretes, fragrances or fragrant molecules.

The active substance is, for example, chosen from the group formed by caffeine, for example for a thinning effect; salicylic acid, iodine, *arnica montana*, decyloxazolidinone, hedera helix, hydrogen peroxide, *melaleuca alternifolia*, mandelic acid, *rosmarinus officinalis*, for example for an antimicrobial and/or anti-acne effect; activated carbon, for example for an anti-pollution effect; ascorbic acid, for example for an anti-free radical effect; collagen, for example for an anti-wrinkle effect; alum, for example for an antiperspirant effect; aloe vera, allantoin, for example for a soothing and/or anti-redness effect; madecassoside, for example for a scar healing effect; a liquid or particulate coloring agent, for example for a coloring effect; azelaic acid, kojic acid, arbutin, for example for a depigmentation effect; algae, *betula alba, ananas sativus*, *camellia sinensis*, citrus medica limonum, eugenol, cola nitida, peppermint, *betula alba, rosmarinus officinalis*, for example for a dynamizing and/or tonifying effect; panthenol, provitamin B5 , cera alba, lanoline, for example for an emollient effect; aloe ferox, dimethiconol, jojoba esters, methyl gluceth-20 , mannitol, castor bean oil, for example for a hydrating effect; calcium gluconate, fructose, glucose, cyclomethicone, zinc PCA, urea, sodium lactate, for example for a moistening effect; glycolic acid, lactic acid, for example for a peeling effect; octocrylene, zinc oxide, titanium dioxide, for example for an anti-UV effect; menthol, camphor, for example for a refreshing effect; hyaluronic acid, for example for a stimulant effect, retinol, for example for a restructuring effect; geraniol, for example for a tonifying effect; vitamin C, citronella and limonene, for example for a vasoconstrictor effect.

The active substance is, for example, a hydrating, fragrant, asepticizing, detoxifying, dynamizing, make-up, strengthening, scarring, vasoactive, bleaching, regenerating, anti-oil, anti-pimple, anti-wrinkle, anti-cellulite, anti-line, anti-brown spot, anti-redness, anti-microorganism, or anti-pollution substance.

Typically, the cosmetic composition has a vaporization temperature less than 70° C.

In reference to the single figure, the device 10 comprises a housing 12 that extends over the single figure along an axis A-A'.

The device 10 is capable of being manually grasped, carried and maneuvered by a user. It advantageously has a mass of less than 1 kg and in particular between 0.005 kg and 0.2 kg. It is intended for storage, transport and dispensing in vaporized form of the cosmetic composition that it contains.

The device 10 comprises a reservoir 14 intended to contain the cosmetic composition, a heating assembly 16 capable of heating the cosmetic composition in order to vaporize it, a control member 18 able to control the heating assembly 16, a diffusion chamber 20 for receiving the vaporized cosmetic composition and a driving member 22 capable of moving the vaporized cosmetic composition out of the device 10.

The device 10 also includes an electrical power supply source 24, such as a battery, capable of supplying electrical energy to the heating assembly 16 and/or the driving member 22.

Alternatively, the electrical power supply source 24 is a photoelectric source. In this case, the electrical power supply source 24 is capable of collecting surrounding light energy and transforming it into a current in order to cause the heating member 16 and the driving member 22 of the device 10 to work.

The housing 12 has, for example, a substantially parallelepiped or cylindrical shape, or any other suitable shape. It is, for example, made of a material such as steel, aluminum, or a thermoplastic polymer or a composite material.

The housing 12 internally defines an interior space 26 that leads to a discharge outlet 28 through which the vaporized cosmetic composition is driven out of the device 10. In the interior space 26, the reservoir 14, the electrical power supply source 24, the diffusion chamber 20, the control member 18, the driving member 22 and the heating assembly 16 are arranged.

The reservoir 14 internally defines an interior volume 30 that contains the cosmetic composition. It contains, for example, an absorbing element 32 capable of retaining the cosmetic composition, such as, for example, an element formed by a cellular, woven or non-woven material.

The cosmetic composition retained in the reservoir 14, for example in the liquid state, is advantageously freely accessible by the user by means of a passage for access to the reservoir located on the reservoir, and a system for closing and opening the access passage. Thus, the device 10 enables, in addition to the dispensing of the cosmetic composition in vaporized form, the dispensing of the cosmetic composition in its initial phase.

Advantageously, the reservoir 14 can be removed from the housing 12. It is thus reversibly removable from the housing 12. Also advantageously, the reservoir 14 can be refilled with cosmetic composition. The reservoir 14 includes at least one orifice 34 connecting the interior volume 30 to the diffusion chamber 20.

According to the invention, the cosmetic composition contained in the reservoir 14 is in the liquid state. Alternatively, the cosmetic composition is contained in the reservoir 14 in the form of a gel, an expanded foam, in the form of capsules, crystals or particles of different particle sizes and shapes. Alternatively, the cosmetic composition is contained in the reservoir 14 in solid form.

The heating assembly 16 is capable of heating the cosmetic composition so as to vaporize it. The heating assembly 16 includes, for example, one or more resistors each consisting of a metal wire. Each metal wire is wound around one or more absorbing filaments capable of retaining the liquid to be vaporized. This configuration enables the contact surface between the cosmetic composition thus retained and the heating assembly 16 to be optimized, regardless of the arrangement of the device 10 in space, i.e.

this configuration enables the device 10 to be used even when the latter is oriented in a direction different from that of its natural gravitational direction.

Alternatively, the heating assembly 16 is a printed resistor.

The heating assembly 16 is, for example, arranged in the interior volume 30 of the reservoir 14.

The diffusion chamber 20 is advantageously arranged downstream of the reservoir 14 containing the cosmetic composition. The diffusion chamber 20 is connected to the interior volume 30 of the reservoir 14 by a passage 36 extending opposite the orifice 34 of the reservoir 14. The diffusion chamber 20 receives the vaporized cosmetic composition and comprises, for example, one or more grid(s) such as one or more diffusion, dispersion, fragmentation or retention grid(s) (not shown). The grids make it possible to fraction or, by contrast, group together the molecules present in the vaporized composition. The grids thus make it possible to parameterize the granulometric dimension of the molecules present in the vaporized composition. The or each grid makes it possible, for example, to retain the vaporized composition in the area defined by the grid(s). The diffusion chamber 20 is arranged between the reservoir 14 and the discharge outlet 28 provided in the housing 12 through which the cosmetic composition in the vapor state is driven out of the device 10.

The driving member 22 is capable of moving the vaporized cosmetic composition out of the device 10. The driving member 22 is, for example, a fan. The driving of the vaporized cosmetic composition is, for example, optimized by the venturi effect.

The driving member 22 is advantageously arranged downstream of the reservoir 14 containing the cosmetic composition, for example in the diffusion chamber 20.

Thus, the driving member 22 is capable of generating a gaseous flow of vaporized cosmetic composition, between the reservoir 14 and the discharge outlet 28, through the diffusion chamber 20.

The terms "upstream" and "downstream" refer in this document to the normal direction of movement of the flow of the cosmetic composition vapor.

The control member 18 is able to control the heating assembly 16. More specifically, the control member 18 is able to control the heating assembly 16 so that the vaporized cosmetic composition driven out of the device 10 permanently has, during operation of the device 10, a temperature less than 70° C., and in particular less than 50° C., for example between 30° C. and 50° C., this temperature being measured at the discharge outlet 28.

The control member 18 is, for example, a printed circuit and/or a microprocessor.

The control member 18 includes an activation member 38, capable of being actuated on the housing 12 by a user. The member 38 for activating the control member 18 is, for example, an on-off switch button, or a gradual pressure switch button.

Thus, the control member 18 is capable of heating the heating assembly 16 until the vaporization temperature of the cosmetic composition is reached. It also prevents overheating of the heating assembly 16 beyond a predefined temperature, for example the vaporization temperature of the cosmetic composition.

In particular, the control member 18 prevents the cosmetic composition from being heated beyond a temperature greater than 70° C. and in particular prevents the cosmetic composition from reaching the water vaporization temperature. In addition, the control member 18 prevents user burn risk, as well as the exceeding of the temperature threshold at which the active agents or solvents would degrade.

The control member 18 is further capable of controlling the driving member 22 so as to propel the cosmetic composition vapor out of the device 10.

The control member 18 is, for example, arranged upstream of the reservoir 14.

The electrical power supply source 24 is received in the housing 12 and is advantageously a battery. The battery is, for example, a disposable or a rechargeable battery. The battery is intended to supply electrical energy to the heating assembly 16. Advantageously, the battery also supplies electrical energy to the driving member 22. Also advantageously, the battery supplies electrical energy to the control member 18.

Advantageously, the device 10 comprises one or more light elements 40 capable of emitting light when the control member 18 is activated. The light element 40 is, for example, an LED.

Advantageously, the device 10 further comprises one or more sensors (not shown) capable of detecting the presence of the gaseous flow of vaporized cosmetic composition and capable of activating the control member 18 when the gaseous flow of vaporized cosmetic composition is detected.

Alternatively, the gaseous flow sensors are capable of detecting the introduction of a mechanical air flow and, for example, by an air flow introduction member, such as, for example, a bulb. The gaseous flow sensor is then capable of controlling the activation of the device 10, the gaseous flow sensor then being used as a switch. Alternatively, the or each sensor is, for example, a temperature sensor, a moisture sensor, an oil sensor or an acid-pH sensor. In this alternative, the or each gaseous flow sensor acts as an activation member 38.

The operation of the device 10 according to the invention will now be described.

Initially, the device 10 is supplied with the reservoir 14 containing the cosmetic composition in the liquid or solid state. Then, the user implements the member 38 for activating the control member 18. The control member 18 in turn activates the heating assembly 16, so as to heat the cosmetic composition until its vaporization temperature is reached without being exceeded. Then, the control member 18 activates the driving member 22 so that the vaporized cosmetic composition is driven by means of the driving member 22 through the orifice 34 and the passage 36 into the diffusion chamber 20, then outside the housing 12 through the discharge outlet 28.

Alternatively, the control member 18 simultaneously activates the heating assembly 16 and the driving member 22.

The temperature of the heating assembly 16 is controlled by the control member 18 so that the temperature of the vaporized cosmetic composition is less than 70° C., and in particular less than 50° C., for example between 30° C. and 50° C.

Thus, the cosmetic composition is dispensed in vapor state, instantaneously, without the device 10 requiring a significant time for preheating the heating assembly 16 (since the heating temperature is less than the water vaporization temperature). In addition, the device 10 according to the invention enables a vaporized cosmetic composition to be dispensed at a temperature close to the temperature of the human body, at which the active substances present in the cosmetic composition are easily absorbed at the surface thereof. In addition, the granulometric sizing of the elements forming the vaporized composition enables optimal absorption of the active substances present, and/or the formation of a homogeneous film at the surface of the skin, enabling it to be protected from various stresses such as particulate pollution, ozone, aromatic hydrocarbons or microorganisms. The controlled particle size of the elements forming the film enables risks of dermal blockage to be limited.

Once the cosmetic composition has been dispensed, the user again actuates the activation member 38 of the control member 18 so as to deactivate the control member 18 and therefore the heating assembly 16 and the driving member 22.

The invention claimed is:

1. A device for packaging and dispensing a cosmetic composition, the device comprising:

a housing capable of being grasped by a user of the device;

a reservoir contained in the housing, the reservoir being intended to contain a cosmetic composition, the cosmetic composition comprising at least one active substance;

an assembly for heating the cosmetic composition capable of vaporizing the cosmetic composition; and a control member able to control the heating assembly;

further comprising a driving member capable of moving the vaporized cosmetic composition out of the device, the control member being able to control the heating assembly so that the vaporized cosmetic composition driven out of the device by the driving member permanently has a temperature less than 70° C.

2. The device according to claim 1, wherein the control member is capable of controlling the driving member.

3. The device according to claim 1, further comprising a member for activating the control member, capable of being actuated on the housing by a user of the device.

4. The device according to claim 1, further comprising an electrical power supply source received in the housing, the source being capable of supplying electrical energy to the heating assembly and/or the driving member.

5. The device according to claim 1, further comprising a diffusion chamber arranged between the reservoir and a discharge outlet provided in the housing through which the vaporized cosmetic composition is driven out of the device.

6. The device according to claim 5, wherein the driving member is capable of producing a flow of vaporized cosmetic composition through the diffusion chamber between the reservoir and the discharge outlet.

7. The device according to claim 1, wherein the reservoir includes an absorbing element able to retain the cosmetic composition.

8. The device according to claim 1, wherein the reservoir can be removed from the housing.

9. The device according to claim 1, wherein the housing is able to be manually carried by a user.

10. The device according to claim 1, wherein the vaporization temperature of the cosmetic composition is less than 70° C.

11. The device according to claim 1, wherein the cosmetic composition includes at least one of the elements chosen from the group formed by glycerine, propylene glycol, propanediol, sorbitol, butylene glycol, pentylene glycol, polyethylene glycol 6, polyethylene glycol 8 or mixtures thereof.

12. A method for cosmetic treatment of a keratin surface of a user comprising the following steps:

supplying a device according to claim 1;

implementing the control member to activate the heating assembly;

heating and vaporizing the cosmetic composition;

driving the vaporized cosmetic composition out of the housing; and controlling the temperature of the heating assembly by the control member so that the temperature of the vaporized cosmetic composition permanently has a temperature less than 70° C.

13. The device according to claim 1, wherein the vaporization temperature of the cosmetic composition is less than 50° C.

14. The device according to claim 1, wherein the vaporization temperature of the cosmetic composition is between 30° C. and 50° C.

* * * * *